United States Patent [19]

Macke et al.

[11] Patent Number: 4,830,532

[45] Date of Patent: May 16, 1989

[54] TRACKS FOR SPORTING EVENTS

[75] Inventors: Anthony V. Macke, 1879 U.S. Rte. 52, Moscow, Ohio 45153; Philip E. Shrimpton, Georgetown, Ky.

[73] Assignee: Anthony V. Macke, Moscow, Ohio

[21] Appl. No.: 18,403

[22] Filed: Feb. 25, 1987

[51] Int. Cl.[4] ..... E01C 13/00

[52] U.S. Cl. ..... 404/31; 404/82

[58] Field of Search ..... 404/27, 30, 31, 71, 404/72, 75, 81, 82; 272/3

[56] References Cited

U.S. PATENT DOCUMENTS

| | | | |
|---|---|---|---|
| 175,273 | 3/1976 | Cross | 404/31 |
| 1,094,411 | 4/1914 | Arnold | 404/31 |
| 2,024,158 | 12/1935 | Gallagher | 404/31 |
| 2,117,280 | 5/1938 | Alexander | 404/31 |
| 3,740,303 | 6/1973 | Alderson et al. | 404/31 X |
| 4,523,755 | 6/1985 | Turba | 404/31 X |

FOREIGN PATENT DOCUMENTS

| | | | |
|---|---|---|---|
| 96908 | 12/1983 | European Pat. Off. | 404/31 |

*Primary Examiner*—Jerome W. Massie, IV
*Assistant Examiner*—Matthew Smith
*Attorney, Agent, or Firm*—Charles R. Wilson

[57] ABSTRACT

A cushioned track surface for sporting events comprises superposed courses of materials. The track surface comprises courses of: (a) an underlying course of particulate material, (b) an intermediate course of fibrous material, (c) a binding course of shredded paper and (d) a wear surface course of additional fibrous material. The binding course serves a function of holding together the intermediate and wear surface course of fibrous material so as to prolong the durability of the track surface while at the same time providing good drainage and good footing.

18 Claims, 1 Drawing Sheet

TRACKS FOR SPORTING EVENTS

This invention relates to tracks. More particularly, the invention relates to tracks having desired force cushioning characteristics with good drainage, footing and durability.

BACKGROUND OF THE INVENTION

Tracks for sporting events have been used for many years. They have been extensively used for horse races, dog races, and human sporting events. Tracks have also been built for exercising purposes. Any type of track which is used for an organized event whether professional or amateur must be well maintained to prevent the possibility of injury as well as allow the participant to fully demonstrate or utilize his skills. Thus, even earthen tracks must be periodically smoothed and manicured.

Various attempts have been made to improve upon earthen track surfaces. These attempts have primarily made use of natural materials because of their low cost and ready availability. The particular materials used further depends on the intended use of the track and where located. Outdoor tracks for human sporting events have been made of cinders and other particulate materials. The surfaces of such tracks give good traction and have relatively good drainage. Maintenance of tracks having surfaces of particulate material is minimal because of the surface's natural inclination to settle to a smooth state and form little air borne dust. In more recent years, tracks with various synthetic surfaces have been built. They can have a synthetic foam subsurface and a grass-like top surface commonly referred to as Astroturf. While relatively expensive to build, they do provide good drainage, are long-lasting, are relatively maintenance-free and have good footing.

Tracks intended for use by horses pose special problems. A horse's legs are fragile considering the weight they must carry. Injured horse legs also often do not heal readily or completely, thereby ending the horse's career. Accordingly, horse tracks must be carefully maintained to ensure a smooth surface and a surface which is not too hard. Horse tracks which have jumping events such as in horse shows additionally must have a cushioned surface to reduce the possibility of leg injury. Prior horse tracks usually were built using layers of gravel, ground limestone, sand and soil. These tracks have good drainage and are durable; however, they can get hard unless a great effort is made to wet and drag them on a regular basis.

There is still a need for a track which is economical and relatively low in maintainance. Such a track also would be durable and allow the participant to maximize his skills. In accord with this invention a track primarily intended for outdoor use has been developed which is economical to build and possesses good cushioning characteristics. At the same time the track has good drainage, footing and durability.

SUMMARY OF THE INVENTION

A track surface for sporting events is comprised of superposed courses of (a) an underlying course of particulate material, (b) an intermediate course of fibrous material, (c) a binding course of shredded paper and (d) a wear surface course of a second fibrous material having a density greater than that of the intermediate course fibrous material. When properly applied, the binding course of shredded paper holds together the intermediate and wear surface courses of fibrous materials. Any weight which is exerted upon the wear surface is distributed throughout the various courses. As a result, the track is cushioned. Additionally, the track has good drainage, footing and durability.

DETAILED DESCRIPTION OF THE INVENTION

Figure 1:
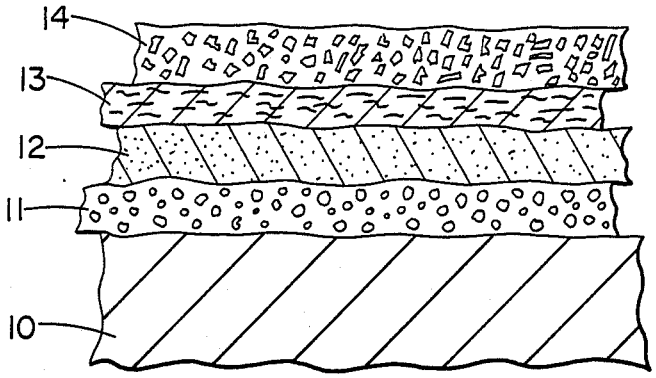
FIG. 1 is a fragmentary sectional view of a track surface in accord with this invention.

The following paragraphs describe the multilayer track of this invention. A method of laying the track is also described.

With reference to FIG. 1 the track of this invention comprises at least four courses of materials laid on an earthen surface 10. Each course is important to achieving the desired objectives. An underlying course 11 is made of particulate material. Examples of suitable particulate materials include, sand, gravel, crushed rock and cinders or a mixture thereof. Various other natural as well as man made materials are used providing they are particulate in nature. The purpose of the particulate course is to provide a means which will allow natural drainage of water throughout the system. Such a course is necessary to prevent freestanding water on the track surface. Generally, the particulate material is laid so as to range in thickness from about two inches to about eight inches, preferably from about three inches to about six inches. The amount of drainage required, of course, will depend on the rainfall of the local area. In some areas the natural soil is sufficiently loose that in effect it is a particulate material providing sufficient drainage. A separately laid underlying course in those areas can be dispensed with.

After the particulate material is laid out in a suitable shape and at a proper depth, a fibrous material 12 is next laid onto the underlying course 11. A fibrous material such as wood chips, sawdust, wood shavings, ground bark, ground wood or a mixture thereof is generally laid at a depth ranging from about two inches to about eight inches. Preferably, the intermediate course of fibrous material ranges in thickness from about three inches to about six inches. A preferred fibrous material for this course is sawdust. It has been found the sawdust in conjunction with the courses superposed on it provides a particularly desirable track with an excellent balance of cushioning or force distributing characteristics and durability.

A binding course 13 of shredded paper is next added onto the intermediate course of fibrous material. Shredded paper in various widths and lengths are used. Many different grades and types of paper are used. Useful papers are broadly classified as newsprint, printing and wrapping paper, packaging and industrial converting papers, industrial papers, tissue paper, and paperboard. The papers are made in conventional manners by the ground-wood process, chemical process (e.g. sulfite, sulfate and soda processes) or semichemical process. The various paper classes are made from the pulp or pulps of the aforementioned processes. Newsprint is economical and most importantly provides a necessary binding function. However, it is less preferred because it tends to disintegrate readily. Preferably, the paper is unvarnished because these papers tend not to knit together to bind adjacent courses and do not provide good drainage. Preferred are those papers made by the sulfite chemical process. These papers possess a good blend of binding capacity and weather resistance. An especially preferred paper is an unvarnished sulfite paper. Shredded paper ranging in width of about one-eighth inch to about one inch and in length of from about one inch to about five inches is preferred.

The binding course of shredded paper holds together the intermediate course of fibrous material and a subsequently applied wear surface course of additional fibrous material. In accord with this invention from about two inches to about eight inches of shredded paper is initially applied. As discussed more fully hereafter a wetting step is used in building the track. The wetting in effect activates the shredded paper so as to perform its binding function. The wetted shredded paper does not adversely affect drainage, yet it does prevent or at least slows the evaporation of water from the intermediate course. This causes the courses to hold together better and also indirectly contributes to a more dust-free wear surface course. Thus, excess water from a rainfall is readily drained from the track while adequate water is retained for binding and reduced dust purposes. The combination of a subsequent wetting step and compaction during use results in the binding course 13 ranging in thickness between about one-half inches to about three inches.

A wear surface course 14 of fibrous material is finally laid. Fibrous materials as above described with respect to the intermediate course are used here as well. The fibrous material used in the wear surface course 14 is more dense than the fibrous material in the intermediate course 12. It has been found a more durable and a more cushioned track is obtained when the fibrous materials with the proper densities are used. A more durable track results from the use of a denser wear surface course because the grinding forces of a participant's feet are better absorbed without dust formation. A more cushioned track is obtained because the denser wear surface course is better able to transmit weight forces throughout the track's courses. Conversely, a less dense fibrous wear surface course tends to more absorb all the weight forces. Preferably, the wear surface fibrous material has a density greater than about 0.85 gm per cc while the intermediate fibrous material has a lesser density.

The wear surface course ranges in thickness from about two inches to about eight inches, preferably from about three inches to about six inches in depth. Preferred fibrous materials for this course are wood chips, ground bark, and ground wood in a long stringy form. Such materials provide good footing and are capable of withstanding a shearing action from the participant's feet on the surface without breaking down. Additionally, such relatively large pieces of material have less surface contact points than smaller pieces and are less likely to freeze together in wet freezing weather. The result is that the track surface remains cushioned in sub-freezing weather while other conventional track surfaces are virtually unuseable because of a hard surface which forms in such weather.

It should be understood the above discussed four courses of materials are necessary to this invention to meet the desired objectives of cushioning, drainage, footing and durability. However, the exact course thicknesses and course materials are dependent upon the ultimate use of the track. For example, a track to be used by horses will require thicker courses of wear surface material, binding material and intermediate material than a track used for human events because of the horse's greater weight. Even, a horse track intended for jumping events will have thicker courses for a greater cushioning effect. Weather conditions of the track's locale will determine the amount of particulate material needed for proper drainage.

Additional materials can be added to the above described multilayer track. For example, a surface which will be used for polo should have a very smooth surface so that the polo ball will properly roll. For this reason, a very fine particulate material such as sand is applied to the wear surface course of fibrous material. The fine particulate material as an added course is also useful with race tracks to help maintain a smooth surface for appearance purposes.

The resultant track of the invention is characterized by its good drainage, footing, and durability. Most importantly, the track provides a cushioned surface at a reasonable cost and without a loss of durability. Any weight forces applied at the wear surface are transmitted to the underlying courses of shredded paper and additional fibrous material. The effect is a cushioning of the weight forces thereby relieving stresses on the legs of any participant. The drainage and durability of the track compares favorably with existing track surfaces. A secondary advantage enjoyed by the track of this invention is that it can readily be renovated. Additional courses of fibrous material, shredded paper and more fibrous material can be added directly to the original track; the original track does not need to be torn up and completely rebuilt.

The track of this invention is built by initially grading a tract of land to the depth necessary to accomodate the four courses. The particulate and intermediate fibrous material courses are laid to the proper depth. Next, a substantial amount of water is applied, preferably by spraying onto the intermediate fibrous material course. This wetting step diminishes dust formation during subsequent application steps as well as causes a proper binding of the shredded paper which is next applied. A second wetting step can be used after the shredded paper binding course is laid, though normally is not necessary. The wear surface course is finally laid and, depending on the moisture content of the fibrous material and weather conditions, optionally wetted to reduce dust formation during use. A stable banked curve can also be provided due to the ability of the courses to hold together.

As should be apparent the invention herein has been described with reference to the drawing. Obvious modifications may be made without departing from the scope of this invention.

What is claimed is:

1. A track for sporting events characterized in having desired force cushioning characteristics with good drainage, footing and durability under varying weather conditions, said track comprised of superposed courses of (a) an underlying course of particulate material, (b) an intermediate course of fibrous material, (c) a binding course of unvarnished shredded paper having a width of from about one-eighth inch to about one inch and a length of from about one inch to about five inches, and (d) a wear surface course of a second fibrous material having a density greater than that of the fibrous material of the intermediate course, wherein the binding course holds the intermediate and wear surface courses of fibrous materials together to provide durability and a cushioning effect as weight forces exerted on the surface course are caused to be distributed more evenly through the courses.

2. The track of claim 1 wherein the underlying course of particulate material ranges in thickness from about two inches to about eight inches.

3. The track of claim 2 wherein the intermediate course of fibrous material ranges in thickness from about two inches to about eight inches.

4. The track of claim 3 wherein the wear surface course of fibrous material ranges in thickness from about two inches to about eight inches.

5. The track of claim 4 wherein the binding course of shredded paper ranges in thickness from about two inches to about eight inches when initially laid and from about one-half inch to about three inches during subsequent use.

6. The track of claim 5 wherein the underlying course of particulate material is sand, gravel, crushed rock, cinders or a mixture thereof.

7. The track of claim 6 wherein the fibrous material used in the intermediate and wear surface courses is wood chips, sawdust, wood shavings, ground bark, ground wood or a mixture thereof.

8. The track of claim 1 wherein the density of fibrous material used in the wear surface course is greater than about 0.85 gm per cc.

9. The track of claim 8 wherein the intermediate course is made of sawdust and the wear surface course is made of wood chips, ground bark, ground wood or a mixture thereof.

10. The track of claim 9 wherein the shredded paper is a sulfite paper.

11. The track of claim 10 wherein the underlying course of particulate material, intermediate course of fibrous material and wear surface course of fibrous material all range in thickness from about three inches to about six inches.

12. A method of building a track for sporting events wherein said track has desired force cushioning characteristics with good drainage, footing and durability, comprising the steps of:

(a) forming an underlying course of particulate material;

(b) laying an intermediate course of fibrous material on said underlying course;

(c) wetting the intermediate course;

(d) laying a binding course of unvarnished shredded paper having a width of from about one-eight inch to about one inch and a length of from about one inch to about five inches onto said wetted intermediate course; and (e) laying a wear surface course of fibrous material having a density greater than that of the intermediate course fibrous material onto said binding course so as to form a superposed composite of courses wherein said intermediate and wear surface courses of fibrous material are held together by the binding course.

13. The method of claim 12 wherein the intermediate course of fibrous materials ranges in thickness from about two inches to about eight inches, the binding course of shredded paper ranges in thickness from about two inches to about eight inches when initially laid and the wear surface course ranges in thickness from about two inches to about eight inches.

14. The method of claim 13 wherein the underlying course of particulate material, intermediate course of fibrous material and wear surface course of fibrous material all range in thickness from about three inches to about six inches.

15. The method of claim 13 wherein the density of the fibrous material used in the wear surface course is greater than about 0.85 gm per cc.

16. The method of claim 15 wherein the fibrous material used in the intermediate course is sawdust and the fibrous material used in the wear surface course is wood chips, ground bark, ground wood or a mixture thereof.

17. The method of claim 16 wherein the shredded paper is a sulfite paper.

18. The method of claim 17 additionally comprising wetting the shredded paper binding course after it is laid.

* * * * *